US008237036B2

(12) United States Patent
Naylor

(10) Patent No.: US 8,237,036 B2
(45) Date of Patent: Aug. 7, 2012

(54) WEIGHTED GUITAR STRAP

(76) Inventor: Joseph F. Naylor, Troy, MI (US)

( * ) Notice: Subject to any disclaimer, the term of this patent is extended or adjusted under 35 U.S.C. 154(b) by 0 days.

(21) Appl. No.: 12/869,728

(22) Filed: Aug. 26, 2010

(65) Prior Publication Data

US 2011/0048211 A1 Mar. 3, 2011

Related U.S. Application Data

(60) Provisional application No. 61/275,409, filed on Aug. 28, 2009.

(51) Int. Cl.
*G10D 3/10* (2006.01)

(52) U.S. Cl. ..... 84/327

(58) Field of Classification Search ..... 84/290, 84/291, 327, 329
See application file for complete search history.

(56) References Cited

U.S. PATENT DOCUMENTS

2007/0088774 A1* 4/2007 Li et al. ..... 708/700
2007/0199426 A1* 8/2007 Tafolla ..... 84/327
2010/0107850 A1* 5/2010 Furuta ..... 84/327

* cited by examiner

*Primary Examiner* — Kimberly Lockett
(74) *Attorney, Agent, or Firm* — DLC Patents, PLLC; Dustin L. Call

(57) ABSTRACT

One example embodiment includes a guitar strap for helping to align a guitar in a correct playing position. The guitar strap includes a strip of material, where the strip of material includes a first end and a second end, and a first attachment, where the first attachment is connected to the first end of the strip of material and where the first attachment is configured to connect to the bottom (side furthest from the guitar neck) of a guitar. The guitar strap also includes a weight pocket, where the weight pocket is located near the first end of the strip of material.

20 Claims, 5 Drawing Sheets

WEIGHTED GUITAR STRAP

CROSS-REFERENCE TO RELATED APPLICATIONS

This application claims the benefit of and priority to U.S. Provisional Patent Application Ser. No. 61/275,409 filed on Aug. 28, 2009, which application is incorporated herein by reference in its entirety.

BACKGROUND OF THE INVENTION

The guitar and related instruments go back a long way in history. Although there have been variations, the basic stringed instrument with a body and a neck remains constant. The guitar is played with the neck raised slightly. The user selects the note to be played by pushing the guitar strings against the neck and strumming the strings. The pressure of the user's finger against the string and the neck changes the length of the string, modifying the note played by strumming the string.

This means, however, that the user is constantly holding the neck of the guitar in a raised position, which can lead to fatigue for the user. In addition, if the user releases the guitar, the neck will be lowered due to the effect of gravity, requiring the user to once again raise the neck.

Many users use a guitar strap to hold the weight of the guitar. However, a guitar strap does not keep the neck of the guitar in an elevated position. When the guitar is released, the neck falls until it is approximately parallel with or angled downward to the floor. That is, the guitar strap can support the weight of the guitar but it does not support the neck in the correct playing position. In addition, the movement of the guitar strap as the guitar neck moves up and down can cause movement of the user's shirt, causing it to bunch and causing additional discomfort to the user.

The effort needed to support the neck of the guitar can cause strain on the user's arm and neck. This strain can cause the user to stop playing sooner than the user would otherwise prefer or can cause repetitive motion type injuries. These injuries can, in turn, make it even more uncomfortable for the user to play the guitar.

In addition, if the user releases the guitar for any reason, either on purpose or accidentally, while playing, it may be difficult for the user to quickly grab the guitar and resume playing. That is, once the user lets go of the neck of the guitar, the user must make extra effort to reach the guitar neck's current position.

Accordingly, there is a need in the art for a device that can support the neck of the guitar in playing position. Additionally, there is need for the device to not add substantially to the weight of the guitar and its attachments. Further, there is a need for the device to be small to avoid substantially interfering with the user's use of the guitar.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a guitar strap for helping to align a guitar in a correct playing position. The guitar strap includes a strip of material, where the strip of material includes a first end and a second end, and a first attachment, where the first attachment is connected to the first end of the strip of material and where the first attachment is configured to connect to the bottom (side furthest from the guitar neck) of a guitar. The guitar strap also includes a weight pocket, where the weight pocket is located near the first end of the strip of material.

Another example embodiment includes a method of manufacturing a guitar strap for helping to align a guitar in a correct playing position. The method includes providing a strip of material, where the strip of material includes a first end and a second end, and providing a first attachment, where the first attachment is connected to the first end of the strip of material and where the first attachment is configured to connect to the bottom (side furthest from the guitar neck) of a guitar. The method also includes providing a weight pocket, where the weight pocket is located near the first end of the strip of material.

Another example embodiment includes a guitar strap for helping to align a guitar in a correct playing position. The guitar strap includes a strip of material, where the strip of material includes a first end and a second end. The guitar strap also includes a first attachment, where the first attachment is connected to the first end of the strip of material and where the first attachment is configured to connect to the bottom (side furthest from the guitar neck) of a guitar, and a second attachment, where the second attachment is connected to the second end of the strip of material and where the second attachment is configured to connect to the guitar. The strip of material is configured to be placed over a user's shoulder and to hold the weight of the guitar. The guitar strap further includes a weight pocket, where the weight pocket is located on the strip of material near the first end, and a weight, where the weight is located in the weight pocket and is configured to at least partially offset the weight of the neck of the guitar.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1:
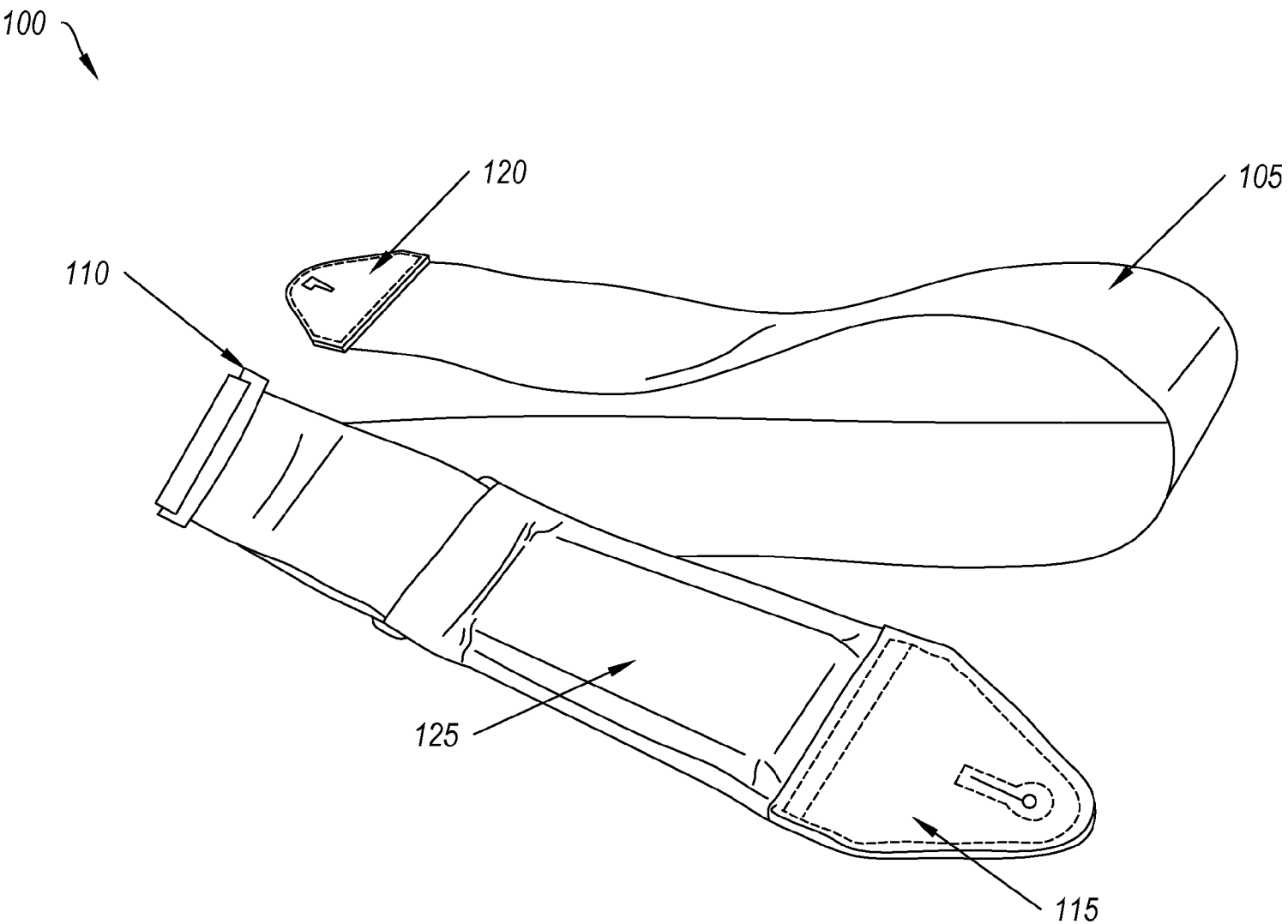
FIG. 1 illustrates an example of a system for holding a guitar in playing position.

FIG. 1 illustrates an example of a system 100 for holding a guitar in playing position. In at least one implementation, the system 100 can be used to balance a guitar in a position as desired by a user. In particular, the system 100 can be used to prevent the neck of the guitar from lowering when released by a user.

FIG. 1 shows that the system 100 includes a strip of material 105. In at least one implementation, the strip of material 105 can be used to support the weight of the guitar when in use. I.e., the strip of material can wrap around or hang over the user's body to support the weight of the guitar, as discussed below.

In at least one implementation, the strip of material 105 can be wide enough that the weight of the guitar is comfortable on the user's body without making the strip of material 105 unwieldy. In particular, the strip of material 105 can be wide enough that the weight of the guitar is distributed over a large area, lowering the pressure on the user's body and making the weight easier for the user to bear. For example, the strip of material 105 can be between 2 and 3 inches wide. In particular, the strip of material 105 can be 2.75 inches wide.

In at least one implementation, the strip of material 105 can be made of any material which can support the weight of the guitar and which is comfortable for the user. In particular, the strip of material 105 can include cloth, such as nylon, polypropylene, cotton, suede, leather or any other material. Materials can include padding to increase the level of user comfort. One of skill in the art will appreciate that the strip of material 105 can include a single material, a blend of materials or multiple materials attached to one another without restriction, unless otherwise specified.

FIG. 1 also shows that the system 100 can include an adjustment means 110. In at least one implementation, the adjustment means 110 allows a user to adjust the length of the strip of material 105. In particular, the adjustment means 110 can allow the user to ensure that the guitar will be held in the position desired by the user. In particular, the adjustment means 110 can allow the user to determine how low on the user's body the guitar will be positioned.

Use of an adjustment means 110 can allow the user to change the length of the strip of material 105. In particular, the adjustment means 110 can allow the user to adjust to any length between a minimum length and a maximum length. For example, the minimum length could be 38 inches and the maximum length could be 62 inches. One of skill in the art will appreciate that the adjustment means 110 can include any mechanism for adjusting the length of the strip of material 105. For example, the adjustment means 110 can include a buckle, snaps, strips configured to attach to one another, hook and loop fasteners, or any other mechanism for adjusting the length of the strip of material 105.

FIG. 1 further shows that the system 100 can include a first attachment 115 connected to a first end of the strip of material 105. In at least one implementation, the first attachment 115 is configured to connect to a guitar. In particular, the first attachment 115 is configured to connect to the body of the guitar, as described below. The first attachment 115 can allow the weight of the guitar to be supported by the strip of material 105. The first attachment 115 can include any material that is strong enough to support the guitar from the strip of material 105. For example, the first attachment 115 can include cloth, leather or any other material. One of skill in the art will appreciate that the first attachment 115 and the strip of material 105 can include a single piece of material or separate pieces of material without restriction.

FIG. 1 further shows that the system 100 can include a second attachment 120 connected to a second end of the strip of material 105. In at least one implementation, the second attachment 120 is configured to connect to a guitar. In particular, the second attachment 120 can connect to the neck of the guitar or can connect to the body of the guitar near the neck of the guitar, as described below. One of skill in the art will appreciate that with the first attachment 115 and the second attachment 120 connected to the guitar, the strip of material 105 can be placed on the shoulder of the user to support the weight of the guitar, as described below. The second attachment 120 can include any material that is strong enough to support the guitar from the strip of material 105. One of skill in the art will appreciate that the second attachment 120 can be made of the same material as the first attachment 115 or can be made of different material than the first attachment 115. One of skill in the art will further appreciate that the second attachment 120 and the strip of material 105 can include a single piece of material or separate pieces of material without restriction.

FIG. 1 also shows that the system 100 can include a weight pocket 125. In at least one implementation, the weight pocket 125 is near the first end of the strip of material 105. As used in the specification and the claims, near the first end of the strip of material 105 shall mean that the element is located in whole or in part on the one half of the strip of material 105 closest to the first end of the strip of material 105 or on the first attachment 115 connected to the strip of material 105, unless otherwise specified. That is, any element described as near the first end of the strip of material 105 will reside, at least partially, on the strip of material 105 less than one half of the total length of the strip of material 105 distance from the first end or on the first attachment 115.

In at least one implementation, the weight pocket 125 is configured to contain one or more weights. The weight pocket 125 can include one or more open sides to allow for the insertion and removal of weights. For example, the weight pocket could include a flap that is configured to open to allow the user to insert additional weights or to remove weights. Additionally or alternatively, the weight pocket 125 can be closed on all sides to prevent removal of the one or more weights.

In at least one implementation, the one or more weights are configured to balance the weight of the guitar neck. As used in the specification and claims, balance the weight of the guitar neck shall mean that the guitar neck is held at or near playing position when the guitar is hanging from the system 100 without external force applied by the user, unless otherwise specified. One of skill in the art will appreciate that the amount of weight required to balance the neck of the guitar will vary depending on the weight of the guitar, the weight of the neck, the attachment point on the guitar and other factors. The one or more weights can weigh between six ounces and sixteen ounces each. In particular, the one or more weights can weigh eight ounces each.

In at least one implementation, the one or more weights can include any material that provides mass. For example, lead can be used as the weight, because of lead's high mass to volume ratio. Additionally or alternatively, the weight can include any other material that provides mass, such as steel, aluminum, wood, stone or any other material. For example, the weight pocket 125 could be transparent or could only cover a portion of the one or more weights and the one or more weights could include a decorative material that is visible when the system 100 is in use.

Figure 2A:
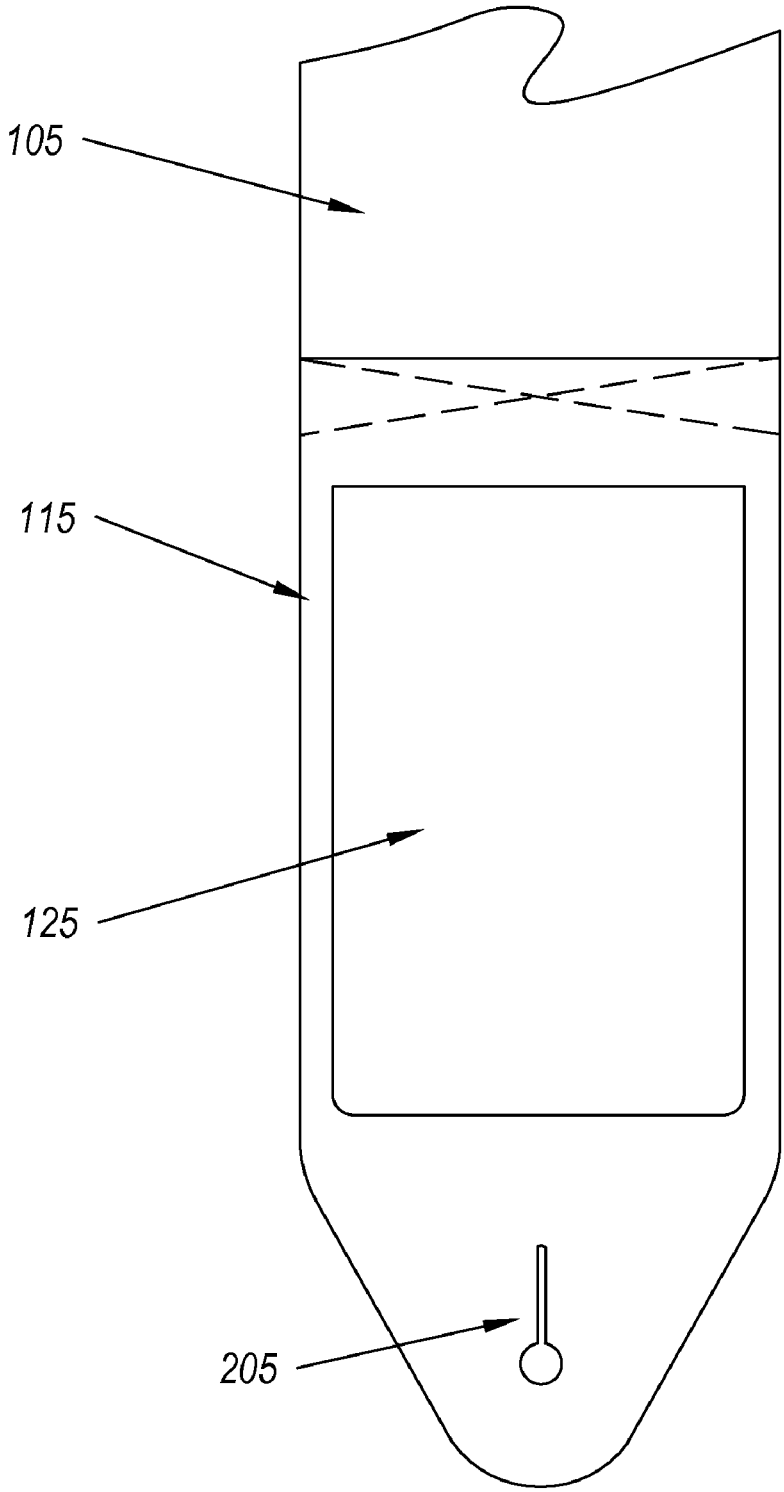
FIG. 2A illustrates a front view of an example of the first attachment.
Figure 2B:
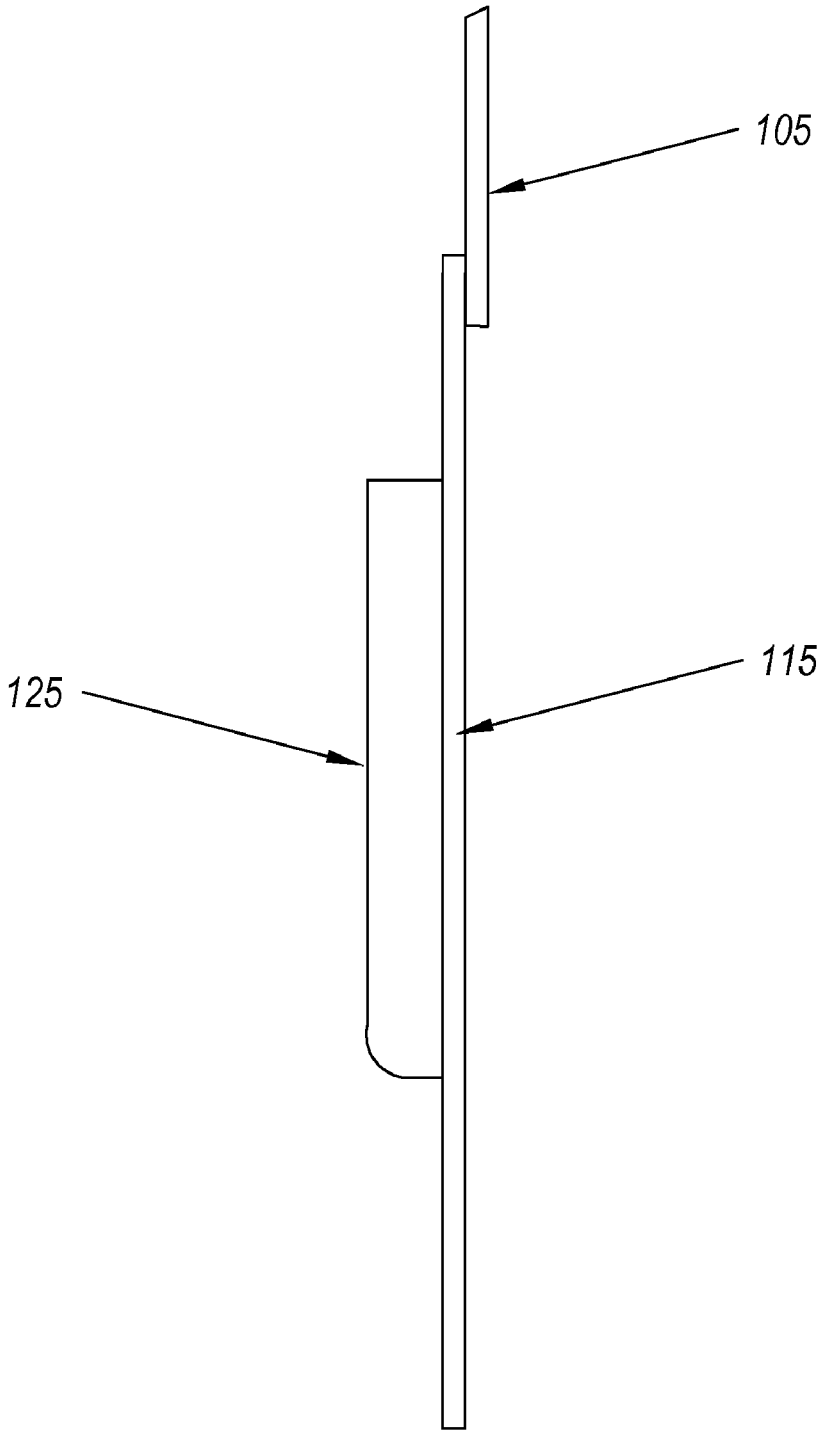
FIG. 2B illustrates a side view of the first attachment of FIG. 2A.

FIGS. 2A and 2B illustrate an example of a first attachment 115. FIG. 2A illustrates a front view of an example of the first attachment 115; and FIG. 2B illustrates a side view of the first attachment 115 shown in FIG. 2A. In at least one implementation, the first attachment 115 is connected to a first end of the strip of material 105. The first attachment 115 can be configured to connect to a guitar. In particular, the first attachment 115 is configured to connect to the body of the guitar, as described below. The first attachment 115 can allow the weight of the guitar to be supported by the strip of material 105. The first attachment 115 can include any material that is strong enough to support the guitar from the strip of material 105. For example, the first attachment 115 can include cloth, leather or any other material.

FIGS. 2A and 2B also shows that the system first attachment can include a weight pocket 125. In at least one implementation, the weight pocket 125 is near the first end of the strip of material 105. In at least one implementation, the weight pocket 125 is configured to contain one or more weights. The weight pocket 125 can include one or more open sides to allow for the insertion and removal of weights. For example, the weight pocket could include a flap that is configured to open to allow the user to insert additional weights or to remove weights. Additionally or alternatively, the weight pocket 125 can be closed on all sides to prevent removal of the one or more weights.

In at least one implementation, the one or more weights are configured to balance the weight of the guitar neck. One of skill in the art will appreciate that the amount of weight required to balance the neck of the guitar will vary depending on the weight of the guitar, the weight of the neck, the attachment point on the guitar and other factors. The one or more weights can weigh between six ounces and sixteen ounces each. In particular, the one or more weights can weigh eight ounces each.

In at least one implementation, the one or more weights can include any material that provides mass. For example, lead can be used as the weight, because of lead's high mass to volume ratio. Additionally or alternatively, the weight can include any other material that provides mass, such as steel, aluminum, wood, stone or any other material. For example, the weight pocket 125 could be transparent or could only cover a portion of the one or more weights and the one or more weights could include a decorative material that is visible when the first attachment 115 is in use.

FIGS. 2A and 2B show that the first attachment 115 can include an opening 205. In at least one implementation, the opening 205 can be configured to connect be placed around a guitar pin attached to the guitar, as described below. Additionally or alternatively, the first attachment 115 can include any mechanism that allows the first attachment to connect to the guitar. For example, the first attachment 115 could include snaps or a hook and loop fastener than is configured to connect to a complimentary structure attached to the guitar.

Figure 3:
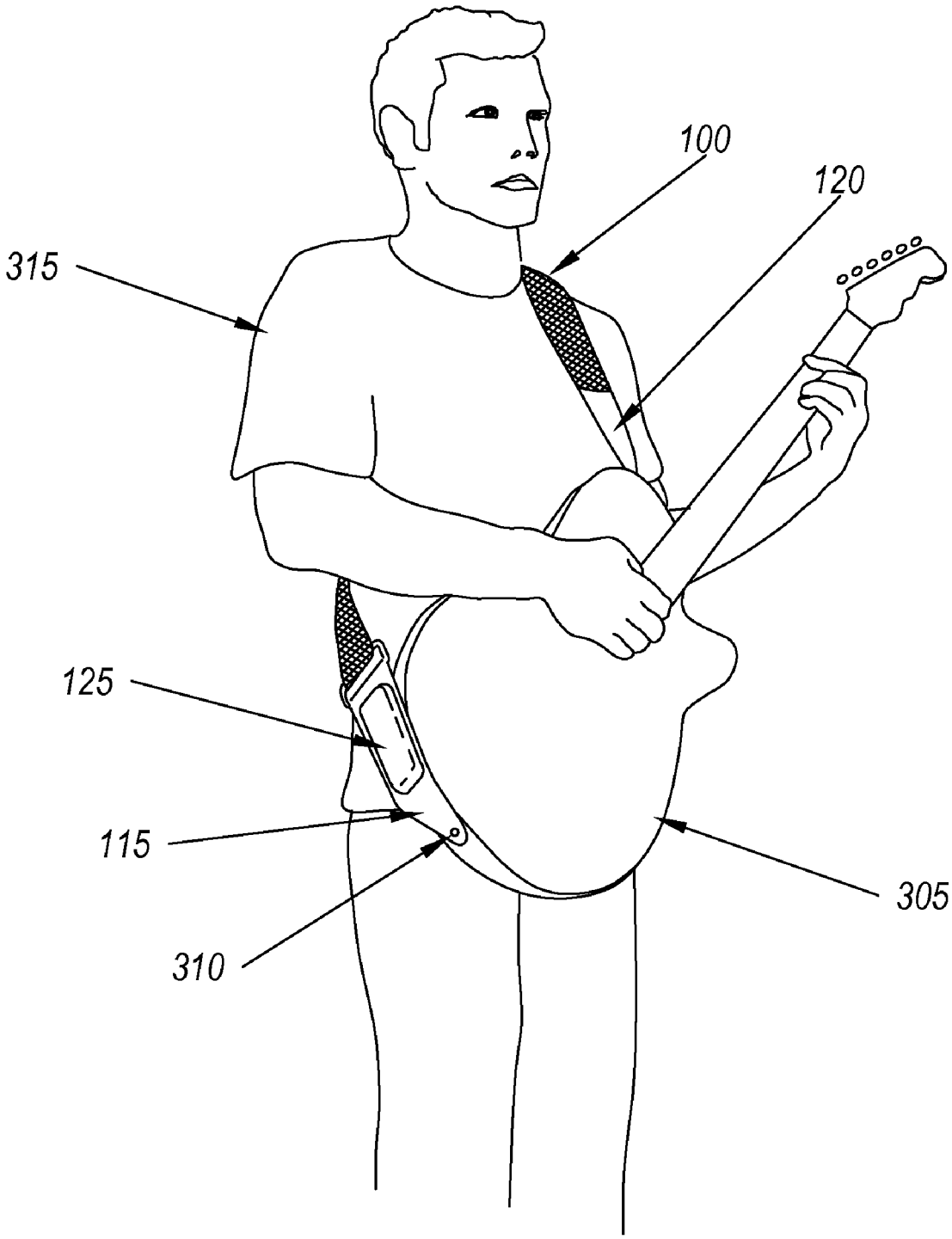
FIG. 3 illustrates an example of the system of FIG. 1 supporting a guitar.

FIG. 3 illustrates an example of the system 100 of FIG. 1 supporting a guitar 305. In at least one implementation, a guitar is a plucked string instrument, played either with fingers or a pick. The guitar includes of a body with a rigid neck to which the strings, generally six in number but sometimes more or less, are attached. Guitars can be constructed of various woods and strung with animal gut or with either nylon or steel strings. Guitars can include both acoustic and electric guitars.

In at least one implementation, acoustic guitars include hollow bodies. The tone of an acoustic guitar is produced by the vibration of the strings, which is amplified by the body of the guitar, which acts as a resonating chamber. Electric guitars rely on an amplifier that can electronically manipulate tone. Electric guitars can include a hollow body or a solid body.

In at least one implementation, the guitar 305 includes one or more guitar pins 310 for receiving an attachment, such as the first attachment 115 or the second attachment 120. In at least one implementation, a guitar pin 310 (a.k.a. a strap button or a strap pin) includes flanged posts anchored to the guitar 305 with screws. Additionally or alternatively, the guitar 305 can include snaps, hook and loop fasteners or strap locks to connect the first attachment 115 to the guitar 305.

In at least one implementation, a first guitar pin 310 can be located at the bottom (bridge end) of the body. Additionally or alternatively, a second guitar pin 310 can be located near or at the top (neck end) of the body: on the upper body curve, at the tip of the upper "horn" (on a double cutaway), or at the neck joint (heel). Additionally or alternatively, one or more guitar pins 310 can be located on the back of the body, on the bottom of the body or on the headstock.

FIG. 3 shows that a user 315 can use the system 100 to support the guitar 305. In at least one implementation, the user 315 can place the system 100 over a shoulder to support the guitar 305. In particular, the system 100 can support the guitar 305 with the neck of the guitar elevated, even when the user 315 releases the guitar. The one or more weights in the weight pocket 125 can allow the neck to remain in the correct playing position while playing. I.e., the user 315 does not have to hold the neck up with his playing hand. This can relieve the user 315 from the physical strain and distraction while playing Additionally or alternatively, the one or more weights in the weight pocket 125 can allow the neck remains in the correct playing position when the player removes his/her hand from the neck to stop playing. Upon resuming playing, the neck is still in the correct playing position. Therefore the transition from stopping and starting playing is faster and easier.

Figure 4:
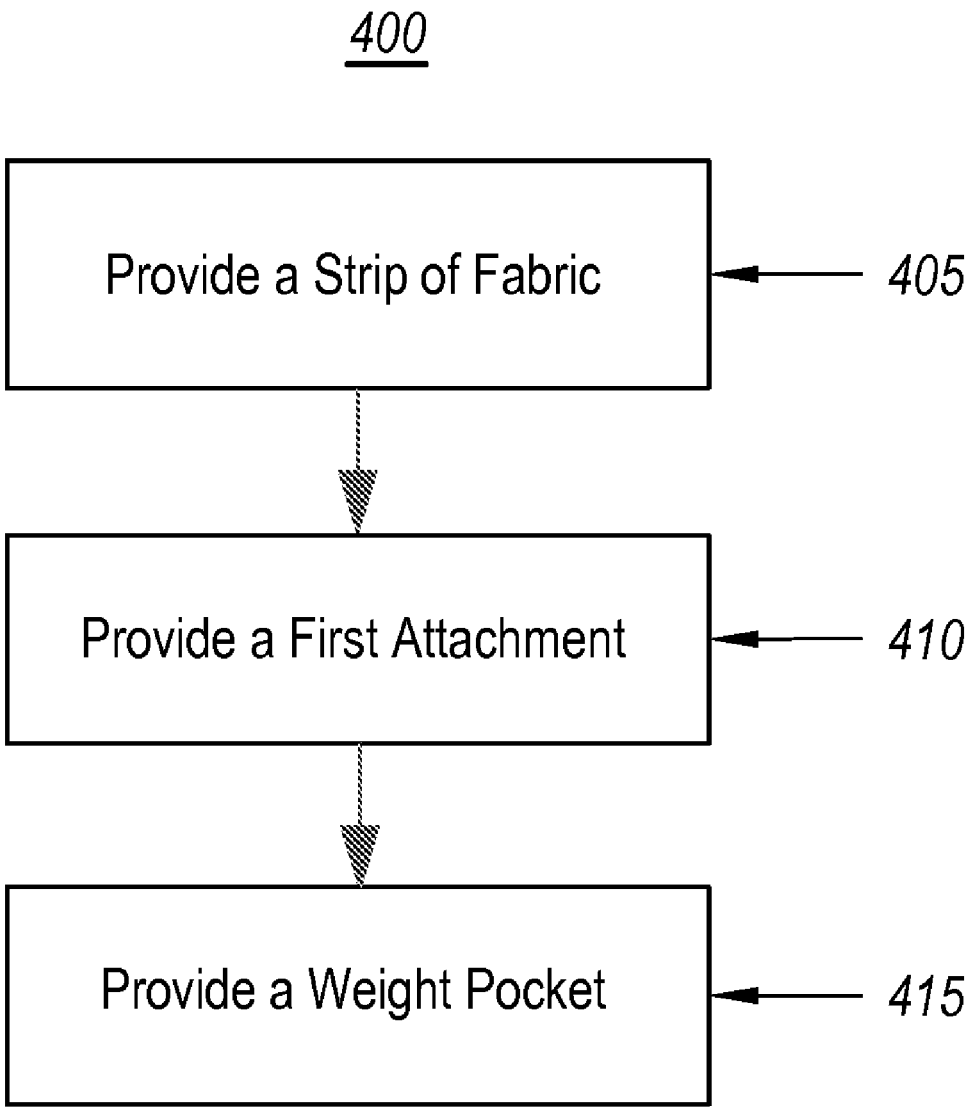
FIG. 4 is a flow chart illustrating a method of manufacturing a system for holding a guitar in playing position.

FIG. 4 is a flow chart illustrating a method 400 of manufacturing a system for holding a guitar in playing position. One of skill in the art will appreciate that the method 400 can be used to produce the system 100 of FIG. 1; however, the method 400 can be used to produce systems other than the system 100 of FIG. 1. In at least one implementation, the system can be used to balance a guitar in a position as desired by a user. In particular, the system can be used to prevent the neck of the guitar from lowering when released by a user.

FIG. 4 shows that the method 400 includes providing a strip of material 405. In at least one implementation, the strip of material can be used to support the weight of the guitar when in use. I.e., the strip of material can wrap around or hang over the user's body to support the weight of the guitar, as discussed above.

In at least one implementation, the strip of material can be wide enough that the weight of the guitar is comfortable on the user's body without making the strip of material unwieldy. In particular, the strip of material can be wide enough that the weight of the guitar is distributed over a large area, lowering the pressure on the user's body and making the weight easier for the user to bear. For example, the strip of material can be between 2 and 3 inches wide. In particular, the strip of material can be 2.75 inches wide.

In at least one implementation, the strip of material can be made of any material which can support the weight of the guitar and which is comfortable for the user. In particular, the strip of material can include cloth, such as nylon, polypropylene, cotton, suede, leather or any other material. Materials can include padding to increase the level of user comfort. One of skill in the art will appreciate that the strip of material can include a single material, a blend of materials or multiple materials attached to one another without restriction, unless otherwise specified.

FIG. 4 also shows that the method 400 can include providing a first attachment 410. The first attachment can be connected to a first end of the strip of material. In at least one implementation, the first attachment is configured to connect to the bottom (side furthest from the guitar neck) of a guitar. In particular, the first attachment is configured to connect to the body of the guitar, as described below. The first attachment can allow the weight of the guitar to be supported by the strip of material. The first attachment can include any material that is strong enough to support the guitar from the strip of material. For example, the first attachment can include cloth, leather or any other material. One of skill in the art will appreciate that the first attachment and the strip of material can include a single piece of material or separate pieces of material, without restriction.

FIG. 4 further shows that the method 400 can include providing a weight pocket 415. In at least one implementation, the weight pocket is near the first end of the strip of material and is configured to contain one or more weights. The weight pocket can include one or more open sides to allow for the insertion and removal of weights. For example, the weight pocket could include a flap that is configured to open to allow the user to insert additional weights or to remove weights. Additionally or alternatively, the weight pocket can be closed on all sides to prevent removal of the weight.

In at least one implementation, the one or more weights are configured to balance the weight of the guitar neck. As used in the specification and claims, balance the weight of the guitar neck shall mean that the guitar neck is held at or near playing position when the guitar is hanging from the system without external force applied by the user, unless otherwise specified. One of skill in the art will appreciate that the amount of weight required to balance the neck of the guitar will vary depending on the weight of the guitar, the weight of the neck, the attachment point on the guitar and other factors. The one or more weights can weigh between six and sixteen ounces each. In particular, the one or more weights can weigh eight ounces each.

In at least one implementation, the one or more weights can include any material that provides mass. For example, lead can be used as the weight, because of lead's high mass to volume ratio. Additionally or alternatively, the weight can include any other material that provides mass, such as steel, aluminum, wood, stone or any other material. For example, the weight pocket could be transparent or could only cover a portion of the one or more weights and the one or more weights could include a decorative material that is visible when the system 100 is in use.

In at least one implementation, the method 400 can also include providing an adjustment means. In at least one implementation, the adjustment means allows a user to adjust the length of the strip of material. In particular, the adjustment means can allow the user to ensure that the guitar will be held in the position desired by the user. In particular, the adjustment means can allow the user to determine how low on the user's body the guitar will be positioned.

Use of an adjustment means can allow the user to change the length of the strip of material. In particular, the adjustment means can allow the user to adjust to any length between a minimum length and a maximum length. For example, the minimum length could be 38 inches and the maximum length could be 62 inches. One of skill in the art will appreciate that the adjustment means can include any mechanism for adjusting the length of the strip of material. For example, the adjustment means can include a buckle, snaps, strips configured to attach to one another, hook and loop fasteners, or any other mechanism for adjusting the length of the strip of material.

In at least one implementation, the method 400 can further include providing a second attachment connected to a second end of the strip of material. In at least one implementation, the second attachment is configured to connect to a guitar. In particular, the second attachment can connect to the neck of the guitar or can connect to the body of the guitar near the neck of the guitar, as described above. One of skill in the art will appreciate that with the first attachment and the second attachment connected to the guitar, the strip of material can be placed on the shoulder of the user to support the weight of the guitar, as described below. The second attachment can include any material that is strong enough to support the guitar from the strip of material. One of skill in the art will appreciate that the second attachment can be made of the same material as the first attachment or can be made of different material than the first attachment.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A guitar strap for helping to align a guitar in a correct playing position, the guitar strap comprising:

a strip of material, wherein the strip of material includes a first end and a second end;

a first attachment, wherein the first attachment is connected to the first end of the strip of material and wherein the first attachment is configured to connect to the bottom of a guitar; and a weight pocket, wherein the weight pocket:

is located near the first end of the strip of material; and is configured to receive a weight, wherein the weight is configured to at least partially offset the weight of the neck of the guitar.

2. The guitar strap of claim 1, further comprising:

a weight, wherein the weight is located in the weight pocket.

3. The guitar strap of claim 2, wherein the weight weighs between 6 ounces and 16 ounces.

4. The guitar strap of claim 3, wherein the weight weighs approximately 8 ounces.

5. The guitar strap of claim 1, further comprising:

a second attachment, wherein the second attachment is connected to the second end of the strip of material and wherein the second attachment is configured to connect to the guitar.

6. The guitar strap of claim 1, wherein the first attachment includes an opening, wherein the opening is configured to be placed around a guitar pin attached to the guitar.

7. The guitar strap of claim 1, wherein the first attachment includes leather.

8. The guitar strap of claim 1, wherein the strip of material includes adjustment means, wherein the adjustment mean allows a user to adjust the length of the strip of material.

9. The guitar strap of claim 8, wherein the adjustment means allows for the length of the guitar strip to be adjustable from 38 to 62 inches.

10. A guitar including the guitar strap of claim 1.

11. A method of manufacturing a guitar strap for helping to align a guitar in a correct playing position, the method comprising:

providing a strip of material, wherein the strip of material includes a first end and a second end;

providing a first attachment, wherein the first attachment is connected to the first end of the strip of material and wherein the first attachment is configured to connect to the bottom of a guitar; and providing a weight pocket, wherein the weight pocket:

is located near the first end; and is configured to receive a weight, wherein the weight is configured to at least partially offset the weight of the neck of the guitar.

12. The method of claim 11, further comprising:

providing a weight, wherein the weight is located in the weight pocket.

13. The method of claim 12, wherein the weight is configured to balance the weight of the guitar neck.

14. The method of claim 12, wherein the weight weighs approximately 8 ounces.

15. The method of claim 11, wherein the strip of material includes polypropylene.

16. The method of claim 11, wherein the strip of material is between 2 and 3 inches wide.

17. The method of claim 16, wherein the strip of material is approximately 2.75 inches wide.

18. A guitar strap for helping to align a guitar in a correct playing position, the guitar strap comprising:

a strip of material, wherein the strip of material includes a first end and a second end;

a first attachment, wherein the first attachment is connected to the first end of the strip of material and wherein the first attachment is configured to connect to the bottom of a guitar;

a second attachment, wherein the second attachment is connected to the second end of the strip of material and wherein the second attachment is configured to connect to the guitar;

wherein the strip of material is configured to be placed over a user's shoulder and to hold the weight of the guitar;

a weight pocket, wherein the weight pocket is located on the strip of material near the first end; and a weight, wherein the weight is located in the weight pocket and is configured to at least partially offset the weight of the neck of the guitar.

19. The guitar strap of claim 18, wherein the first attachment is configured to connect with a first guitar pin.

20. The guitar strap of claim 19, wherein the second attachment is configured to connect with a second guitar pin.

* * * * *